US010174730B2

(12) United States Patent
Harcombe

(10) Patent No.: US 10,174,730 B2
(45) Date of Patent: Jan. 8, 2019

(54) FUEL INJECTOR

(75) Inventor: Anthony Thomas Harcombe, Richmond (GB)

(73) Assignee: DELPHI TECHNOLOGIES IP LIMITED (BB)

( * ) Notice: Subject to any disclaimer, the term of this patent is extended or adjusted under 35 U.S.C. 154(b) by 2082 days.

(21) Appl. No.: 13/392,155

(22) PCT Filed: Jul. 22, 2010

(86) PCT No.: PCT/EP2010/060672

§ 371 (c)(1),
(2), (4) Date: Mar. 14, 2012

(87) PCT Pub. No.: WO2011/023475

PCT Pub. Date: Mar. 3, 2011

(65) Prior Publication Data

US 2012/0174893 A1 Jul. 12, 2012

(30) Foreign Application Priority Data

Aug. 26, 2009 (EP) ..... 09168746

(51) Int. Cl.
*F02M 61/18* (2006.01)
*F02M 61/20* (2006.01)
*F02M 47/02* (2006.01)

(52) U.S. Cl.
CPC ..... *F02M 47/02* (2013.01); *F02M 61/20* (2013.01); *F02M 61/205* (2013.01); *F02M 61/18* (2013.01);
(Continued)

(58) Field of Classification Search
CPC ..... F02M 2547/00; F02M 61/18; F02M 2547/005; F02M 61/20; F02M 61/205;
(Continued)

(56) References Cited

U.S. PATENT DOCUMENTS 6,089,470 A * 7/2000 Teerman ..... F02M 57/023 239/88
6,367,453 B1 * 4/2002 Igashira ..... F02M 47/027 123/467

(Continued)

FOREIGN PATENT DOCUMENTS

DE 10132501 10/2002
DE 102005054927 5/2007

(Continued)

OTHER PUBLICATIONS

English Translation of First Japan Office Action dated Jun. 20, 2013.

(Continued)

*Primary Examiner* — Jason Boeckmann
*Assistant Examiner* — Joseph A Greenlund
(74) *Attorney, Agent, or Firm* — Joshua M. Haines

(57) ABSTRACT

A fuel injector for use in delivering fuel to an internal combustion engine includes a nozzle having a valve needle which is moveable with respect to a valve needle seating through a range of movement between a fully-closed position and a fully-open position to control fuel delivery through at least one nozzle outlet, whereby movement of the nozzle needle is controlled by fuel pressure within a control chamber. A nozzle control valve controls fuel flow into and out of the control chamber to pressurize and depressurize the control chamber, respectively. The fuel injector also includes a variable flow passage in communication with the control chamber through which fuel flows out of the control chamber at a variable rate throughout the range of movement of the valve needle so that movement of the valve needle is damped to a greater extent as it approaches the fully-open position.

18 Claims, 2 Drawing Sheets

(52) U.S. Cl.
CPC . *F02M 2200/304* (2013.01); *F02M 2547/005* (2013.01); *F02M 2547/008* (2013.01)

(58) Field of Classification Search
CPC ..... F02M 47/02; F02M 220/304; F02M 2547/008
USPC ..... 123/466; 239/533.2, 533.3, 533.4, 96
See application file for complete search history.

(56) References Cited

U.S. PATENT DOCUMENTS 6,460,785 B2 * 10/2002 Popp ..... F02M 47/046 239/533.2
6,467,391 B2 * 10/2002 Desai ..... F02M 57/025 239/533.2
6,688,537 B2 * 2/2004 Boecking ..... F02M 47/027 239/533.3
6,702,207 B2 * 3/2004 Seelbach ..... F02M 47/027 239/533.2
6,745,750 B2 * 6/2004 Egler ..... F02M 55/04 123/447
6,745,953 B2 * 6/2004 Boecking ..... F02M 45/02 239/533.3
6,789,743 B2 * 9/2004 Baranowski ..... F02M 47/027 239/102.1
6,814,302 B2 * 11/2004 Stoecklein ..... F02M 47/027 239/533.2
6,880,766 B2 * 4/2005 Lewis ..... F02M 47/027 239/124
6,889,659 B2 * 5/2005 Magel ..... F02M 57/025 123/446
6,953,162 B2 * 10/2005 Hans ..... F02M 51/0671 239/533.1
6,988,680 B1 * 1/2006 Boecking ..... F02M 47/027 239/533.3
7,134,616 B2 * 11/2006 Dong ..... F02M 57/02 239/533.8
7,188,782 B2 * 3/2007 Magel ..... F02M 57/025 239/533.2
7,228,845 B2 * 6/2007 Yamamoto ..... F02M 57/025 123/446
7,267,109 B2 * 9/2007 Boehland ..... F02M 45/086 123/299
7,273,185 B2 * 9/2007 Magel ..... F02M 47/027 239/533.1
7,398,765 B2 * 7/2008 Yamamoto ..... F02M 57/025 123/467
7,513,241 B2 * 4/2009 Ganser ..... F02M 57/025 123/467
7,874,502 B2 * 1/2011 Harcombe ..... F02M 45/08 239/124
7,954,729 B2 * 6/2011 Ricco ..... F02M 47/027 239/585.1
8,459,575 B2 * 6/2013 Ricco ..... F02M 47/027 123/472
2003/0056757 A1 * 3/2003 Tian ..... F02M 47/027 123/446
2003/0106947 A1 * 6/2003 Koch-Groeber ..... F02M 47/027 239/533.2
2003/0188789 A1 * 10/2003 Schoepke ..... F02M 47/027 137/625.65
2004/0000600 A1 * 1/2004 Peters ..... F02M 47/025 239/533.2
2004/0050954 A1 * 3/2004 Yamada ..... F02M 47/027 239/102.2
2004/0069863 A1 * 4/2004 Mattes ..... F02M 47/02 239/88
2005/0133629 A1 * 6/2005 Stringfellow ..... F02M 47/027 239/533.2
2005/0194463 A1 * 9/2005 Boecking ..... F02M 45/12 239/96
2005/0263621 A1 * 12/2005 Brenk ..... F02M 45/02 239/533.2
2006/0151636 A1 7/2006 Harcombe et al.
2006/0196974 A1 * 9/2006 Chen ..... F02M 45/12 239/533.2
2006/0208106 A1 9/2006 Boehland et al.
2006/0219805 A1 * 10/2006 Boecking ..... F02M 47/027 239/96
2006/0243252 A1 * 11/2006 Eisenmenger ..... F02M 47/027 123/447
2008/0203194 A1 * 8/2008 Aoki ..... F02M 61/1806 239/533.12
2011/0049272 A1 * 3/2011 Harcombe ..... F02M 47/027 239/584
2012/0174893 A1 * 7/2012 Harcombe ..... F02M 47/02 123/446

FOREIGN PATENT DOCUMENTS

| | | |
|---|---|---|
| EP | 1318294 | 6/2003 |
| JP | 11-173234 | 6/1996 |
| WO | 2002/097258 | 12/2002 |
| WO | 2004/016936 | 2/2004 |
| WO | 2006/093603 | 8/2006 |
| WO | 2008/077657 A1 | 7/2008 |

OTHER PUBLICATIONS

English Translation of First China Office Action dated Jul. 22, 2013.
International Search Report dated Oct. 13, 2010.

* cited by examiner

FUEL INJECTOR

TECHNICAL FIELD

The invention relates to a fuel injector for use in the delivery of fuel to a combustion space of an internal combustion engine, and particularly to a fuel injector suitable for delivering small quantities of fuel across a wide range of fuel pressures.

BACKGROUND TO THE INVENTION

To optimise diesel engine combustion, it is necessary to have precise control over the quantities of fuel delivered by the fuel injectors. It is desirable to be able to inject small quantities of fuel across a wide range of fuel pressures. For heavy-duty applications in particular, the fuel injectors must be capable of delivering fuel in small quantities at very high fuel pressures.

Typically, a fuel injector includes an injection nozzle having a nozzle needle which is movable towards and away from a nozzle needle seating so as to control fuel injection into the engine. The nozzle needle is controlled by means of a nozzle control valve (NCV), which controls fuel pressure in a control chamber for the nozzle needle.

Small and controllable injection quantities can be achieved by reducing the opening rate of the valve needle during the needle-opening phase, whilst maintaining a high closing rate during the needle-closing phase. One way of achieving an asymmetric opening and closing characteristic is to modify the NCV to define a restricted flow path for fuel flow between the control chamber and a low pressure drain, as described in WO 2004/005702.

A further requirement of the needle-opening phase is that movement of the valve needle is not hindered unduly by the effect of Bernoulli forces as the valve needle lifts away from the nozzle needle seating. It is also important that the needle does not approach its lift stop at such a high speed that it suffers needle bounce, and that the rate of movement of the valve needle during the intermediate stages of lift is within desired limits.

It is an object of the invention to provide a fuel injector which achieves the aforementioned requirements of the needle-opening phase.

SUMMARY OF THE INVENTION

According to the present invention, there is provided a fuel injector for use in delivering fuel to an internal combustion engine, the fuel injector comprising a nozzle having a valve needle which is moveable with respect to a valve needle seating through a range of movement between a fully-closed position and a fully-open position to control fuel delivery through a nozzle outlet, whereby movement of the valve needle is controlled by fuel pressure within a control chamber. A nozzle control valve controls fuel flow into and out of the control chamber to pressurise and depressurise the control chamber, respectively. The fuel injector further comprises a variable flow passage means in communication with the control chamber for varying the rate of flow of fuel out of the control chamber throughout the range of movement of the valve needle such that movement of the valve needle is damped to a greater extent as it approaches the fully-open position compared to initial movement away from the fully-closed position. The fuel injector also includes an additional flow passage in communication with the control chamber through which fuel flows out of the control chamber.

The invention provides the benefit that the rate of flow of fuel out of the control chamber to reduce the pressure in the control chamber to cause the valve needle to lift to commence injection is varied throughout the range of movement of the valve needle. The variable flow passage means is configured so that valve needle movement is more heavily damped as the valve needle approaches the end of its range of travel (i.e. full lift), compared to the initial movement of the valve needle when damping is selected at an appropriate low level to overcome Bernoulli forces. This prevents problems such as "needle bounce" which can occur when the valve needle reaches the end of its range of travel and approaches its lift stop too quickly. The variable flow passage means is configured to provide damping within an acceptable range during the intermediate stages of lift. Furthermore, as the rate of opening of the nozzle is controlled accurately by the variable restriction to fuel flow out of the control chamber, this allows precise control over the quantity of fuel delivered to the engine over a range of fuel pressures.

The additional flow passage ideally presents a fixed restriction to the fuel flow out of the control chamber.

Preferably, the injector is configured so that fuel also flows into the control chamber through at least one of the variable flow passage means and the additional flow passage.

The valve needle or a part carried thereby may include a formation at its end remote from the valve needle seating which cooperates with the additional flow passage to provide a further localised damping effect for the valve needle just prior to it reaching its fully-open position at the very end of its range of travel.

In a preferred embodiment, the variable flow passage means is provided by cooperation between the valve needle (or a part carried thereby) and a flow passage into the control chamber, whereby the valve needle (or the part carried thereby) cooperates with the flow passage to a variable degree to provide a variable rate of flow of fuel out of the control chamber.

By way of example, an entry port to the flow passage into the control chamber is uncovered by the valve needle (or the part carried thereby) to a lesser degree when the valve needle is in the fully-open position compared to the extent to which the entry port to the flow passage is uncovered when the valve needle is in the fully-closed position. In one configuration, the entry port to the flow passage is fully covered by the valve needle (or the part carried thereby) when the valve needle is in the fully-open position. Also, the entry port to the flow passage may be at least partially uncovered by the valve needle (or the part carried thereby) when the valve needle is in the fully-closed position.

One benefit of having the entry port to the flow passage fully covered by the valve needle (or the part carried thereby) when the valve needle is in the fully-open position is that the size of the variable flow passage can be difficult to achieve accurately between units, whereas if the final stage of damping is governed solely by an additional flow passage of fixed restriction this is more difficult to achieve consistently between units.

In one particular embodiment, the entry port to the flow passage may be fully uncovered when the valve needle is in the fully-closed position. For example, the entry port to the flow passage may remain fully uncovered for a portion of the range of movement of the valve needle immediately following initial movement away from the fully-closed position.

The nozzle control valve is conveniently a three-way control valve, but it may also be configured as a two-way valve.

The control chamber is preferably defined in an upper surface of an injector body within which the valve needle or the part carried thereby is guided and wherein a shim plate closes the open end of the control chamber. The shim plate may be provided with a shim plate chamber which receives a portion of a valve pin of the control valve. The use of the shim plate provides manufacturing advantages, as explained in further detail below.

The shim plate is preferably located between the injector body and a control valve housing for the nozzle control valve (10), so that it separates the two, the nozzle control valve having first and second valve seats defined by the injector body and the nozzle control valve, respectively. The shim plate is preferably provided with a shim plate chamber which extends through the shim plate and receives a portion of a valve pin of the control valve.

DETAILED DESCRIPTION OF PREFERRED EMBODIMENTS

Figure 1:
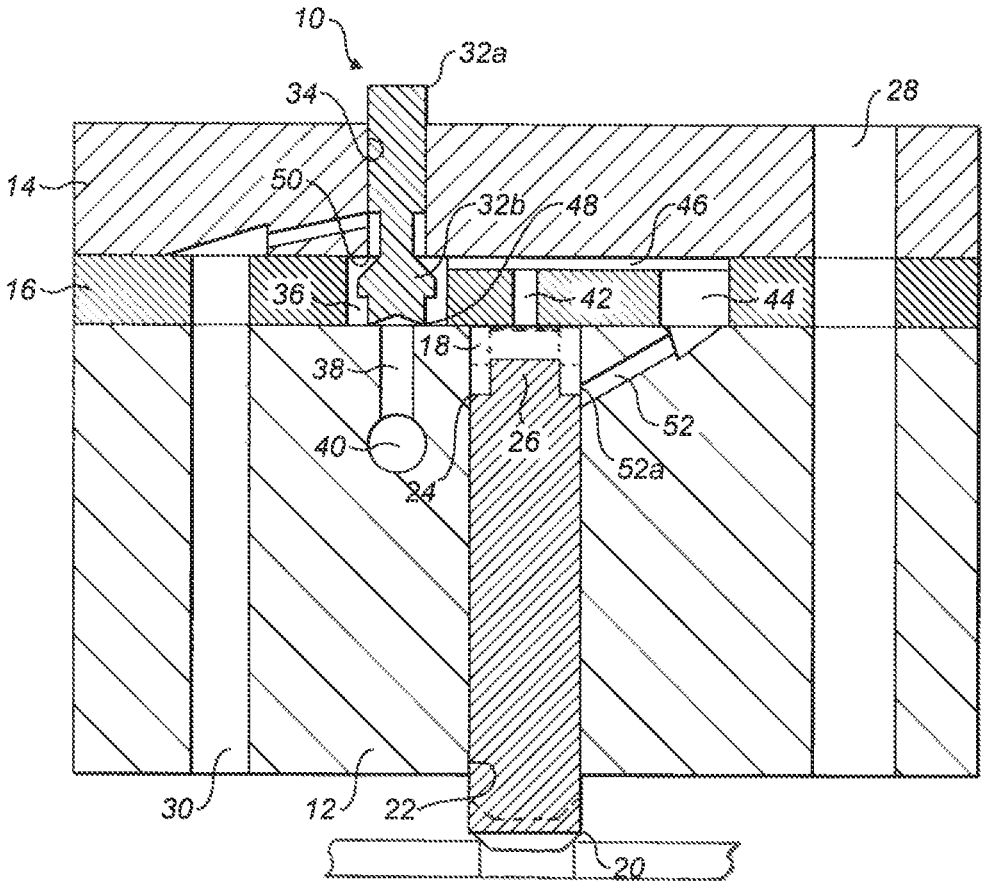
FIG. 1 is a schematic diagram of a fuel injector of a first embodiment of the invention, including a variable spill path from a control chamber at the upper end of the injector valve needle.

FIG. 1 is a schematic view of a part of a fuel injector for use in delivering fuel to an engine cylinder or other combustion space of an internal combustion engine. The fuel injector comprises an injector nozzle (only part of which is shown) and a three-way nozzle control valve (NCV) 10. The injector nozzle includes an injector body or injector housing 12. The NCV 10 is housed within a ncv housing 14 and a shim plate 16, which spaces apart the injector body 12 and the ncv housing 14.

The injector nozzle further includes a valve needle which is operable by means of the NCV 10 to control fuel flow into an associated combustion space (not shown) through nozzle outlet openings. A lower part of the valve needle is not shown, but terminates in a valve tip which is engageable with a valve needle seat so as to control fuel delivery through the outlet openings into the combustion space. A spring may also be provided for biasing the valve needle towards the valve needle seat.

As can be seen in FIG. 1, an upper end 20 of the valve needle remote from the outlet openings is located within a control chamber 18 defined within the injector body 12. The upper end of the valve needle may be referred to as the "needle piston" 20, sliding movement of which is guided within a guide bore 22 provided in the injector body 12. The needle piston 20 may be integral with the lower part of the valve needle, but alternatively may be a separate part carried by the valve needle. A step 24 along the length of the needle piston 20 is defined between the guided portion of the needle piston and a formation in the form of a reduced diameter tip 26 at its uppermost end.

In use, fuel under high pressure is delivered from a first fuel supply passage 28 to a nozzle chamber (not shown) within which the lower part of the valve needle is located. From the nozzle chamber, high pressure fuel is able to flow through the outlet openings of the nozzle when the valve needle is moved away from the valve needle seat.

The control chamber 18 is located axially in line with and above the needle piston 20 in the orientation shown in FIG. 1. The control chamber 18 is defined within the injector body 12 in part by the guide bore 22 and in part by an end surface of the tip 26 of the needle piston 20, and is closed by the lower surface of the shim plate 16. Fuel pressure within the control chamber 18 applies a force to the needle piston 20, which serves to urge the needle piston in a downward direction and, hence, serves to urge the valve needle against the valve needle seat to prevent fuel injection through the outlet openings. Fuel under high pressure is delivered from a second fuel supply passage 30 to the control chamber 18 via the NCV 10.

In use, with high pressure fuel supplied to the nozzle chamber through the supply passage 28, an upwards force is applied to a thrust surface or surfaces (not shown) of the valve needle which serves to urge the valve needle away from the valve needle seat. If fuel pressure within the control chamber 18 is reduced sufficiently, the upwards force acting on the thrust surface due to fuel pressure within the nozzle chamber, in addition to the force from the gas pressure in the combustion chamber acting on the tip of the valve needle, is sufficient to overcome the downwards force acting on the end surface of the needle piston 20, and the force on the valve needle provided by the spring (the spring pre-load force). The valve needle therefore lifts away from the valve needle seat to commence fuel injection through the nozzle outlets. If fuel pressure within the control chamber 18 is increased, the force acting to lift the valve needle away from the valve needle seat is overcome by the increased force due to fuel pressure in the control chamber 18 and the valve needle is seated. Thus, by controlling fuel pressure within the control chamber 18, initiation and termination of fuel injection through the outlet openings can be controlled.

The pressure of fuel within the control chamber 18 is controlled by means of the NCV 10. The NCV 10 includes a valve pin including an upper portion 32*a* and a lower portion 32*b*. The upper portion of the valve pin, referred to as the guide portion 32*a*, is slidable within a guide bore 34 defined in the NCV housing 14. The lower portion of the valve pin, referred to as the head portion 32*b*, is located and slidable within a shim plate chamber 36 defined within the shim plate 16, and moves in sympathy with the guide portion 32*a*. The injector body 12, adjacent to the lower face of the shim plate, is provided with a drain passage 38 which opens into the shim plate chamber 36. The drain passage 38 communicates with a low pressure drain 40. The shim plate 16 is provided with first and second axial through-drillings, 42, 44 respectively, and a cross slot 46 on its upper face which communicates with the first and second axial drillings 42, 44 at their uppermost ends and connects, at one end, with the shim plate chamber 36.

It should be noted at this point that although in this embodiment the cross slot 46 is described as being defined wholly within the shim plate 16, it is also possible for the cross slot 46 to be defined at least partly and, indeed, wholly, within the underside surface of the NCV housing 14.

The upper face of the injector body 12 defines a first valve seat 48 for the head portion 32*b* of the valve pin of the NCV 10. The head portion 32*b* of the valve pin, more specifically the lower end face of the head portion 32*b*, is engaged with the first valve seat 48 when the valve pin is moved into a first valve position, in which circumstances communication between the shim plate chamber 36 and the drain passage 38 is broken and communication between the shim plate chamber 36 and the second supply passage 30 is open. The NCV housing 14 defines, at its lower surface, a second valve seat 50 for the head portion 32*b* of the valve pin, more specifically a frustoconical shoulder portion of the head portion 32*b*. The head portion 32*b* of the valve pin is engaged with the second valve seat 50 when the valve pin is moved into a second valve position, in which circumstances communication between the second supply passage 30 and the shim plate chamber 36 is broken and communication between the shim plate chamber 36 and the drain passage 38 is open.

Conveniently, the valve pin is biased into engagement with the first valve seat 48 by means of a spring (not shown) or other biasing means. Movement of the valve pin 32*a*, 32*b* is controlled by means of an electromagnetic actuator arrangement (not shown), or another suitable actuator such as a piezoelectric actuator or a magnetorestrictive actuator.

Figure 2:
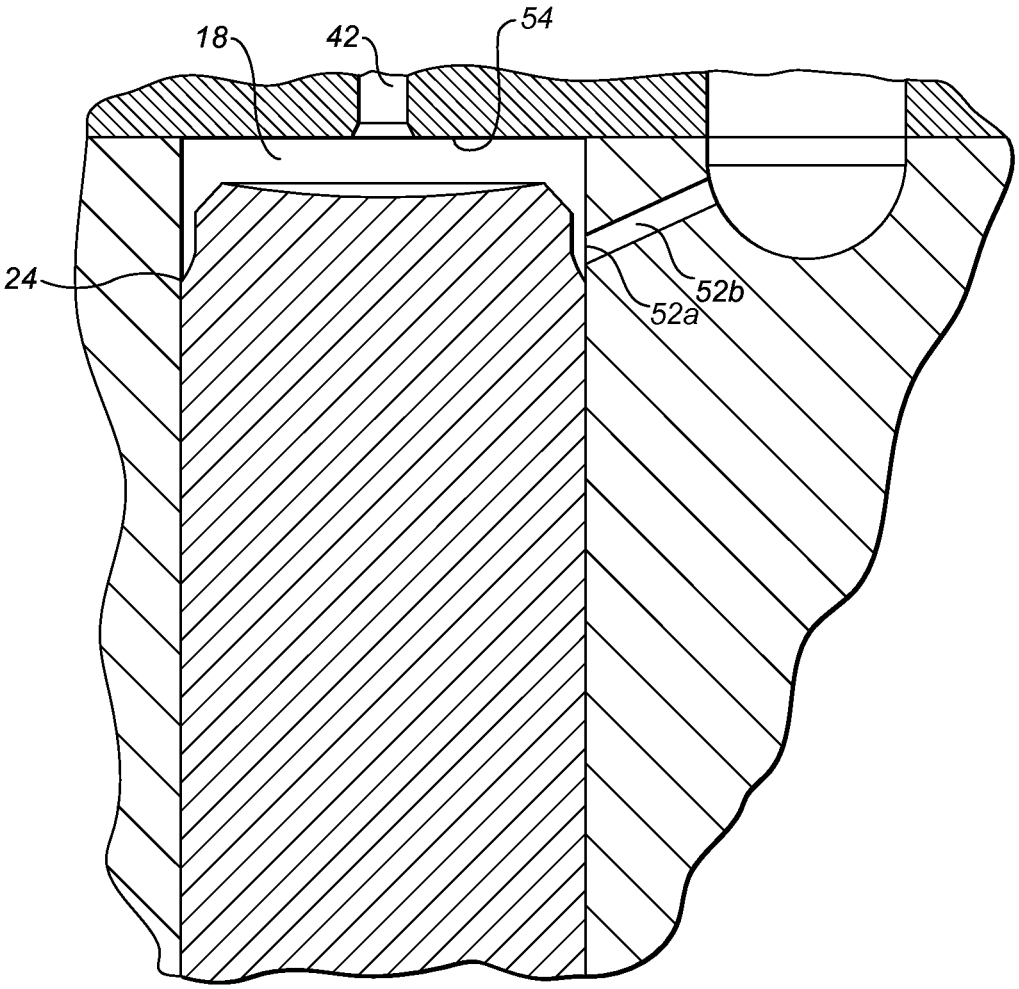
FIG. 2 is an enlarged sectional view of the end of the valve needle of the injector in FIG. 1.

The injector body 12 is provided with a flow passage 52 which communicates with the control chamber 18 at the upper end of the needle piston 20, intersecting the control chamber 18 at an oblique angle. Referring also to FIG. 2, the flow passage includes an entry port 52*a* into the control chamber 18 which is defined at an end of a restricted portion 52*b* of the flow passage. The outer surface of the needle piston 20 is cooperable with the entry port 52*a*, with the position of the needle piston 20 within the guide bore 22 determining the extent to which the entry port 52*a* is covered and, hence, the extent to which communication between the control chamber 18 and the flow passage 52 is open.

The second axial drilling 44 in the shim plate chamber 36 opens at the lower face of the shim plate 16 and communicates with the end of the flow passage 52 remote from the entry port 52*a*. The first axial drilling 42 in the shim plate 16 also opens at the lower face of the shim plate 16 and communicates with the control chamber 18 directly. Therefore, between the shim plate chamber 36 and the control chamber 18 there are two flow routes for fuel: a first route via the flow passage 52 in the injector body 12, the second axial passage 44 in the shim plate 16 and the cross slot 46, and a second route via the first axial passage 42 in the shim plate 16 and the cross slot 46.

In use, when the ncv 10 is de-actuated, the valve pin 32*a*, 32*b* is in its first valve position such that the head portion 32*b* is in engagement with the first valve seat 48 under the spring force. In this position, fuel at high pressure is able to flow from the second supply passage 30 past the second valve seat 50 and into the shim plate chamber 36, from where it can flow into the control chamber 18 through the first route (via the cross slot 46 and the first axial passage 42 in the shim plate 16) and the second route (via the cross slot 46, the second axial passage 44 and the flow passage 52 in the injector body 12). In such circumstances, the control chamber 18 is pressurised and the needle piston 20 is urged downwards, hence the valve needle is urged downwards against the valve needle seat so that injection through the outlet openings does not occur. It will be appreciated that pressurising the control chamber 18 ensures the upwards force acting on the thrust surface of the valve needle, in combination with any force due to combustion chamber pressure acting on the tip of the valve needle, is overcome sufficiently to seat the valve needle against the valve needle seat.

When the ncv 10 is actuated, that is when the valve pin 32*a*, 32*b* is moved away from the first valve seat 48 into engagement with the second valve seat 50, high pressure fuel within the second supply passage 30 is no longer able to flow past the second valve seat 50 to the control chamber 18. Instead, fuel within the control chamber 18 is able to flow past the first valve seat 48 into the drain passage 38 to the low pressure drain 40. Fuel pressure within the control chamber 18 is therefore reduced and the control chamber is depressurised. As a result, the valve needle is urged upwards away from the valve needle seat due to the force of fuel pressure within the nozzle chamber acting on the thrust surface of the valve needle. A region of the lower surface of the shim plate 16 directly above the needle piston 20 provides an upper lift stop 54 that limits the maximum extent of movement of the needle piston 20 and, hence, the maximum extent of movement of the valve needle away from the valve needle seat.

The rate at which the valve needle is caused to move away from the valve needle seat is determined by the rate of flow of fuel out of the control chamber 18 to the low pressure drain 40. Initially, when the valve needle is seated and when the needle piston 20 adopts its lowermost position within the guide bore 22, the entry port 52*a* to the flow passage 52 is fully uncovered by the needle piston 20 so that a relatively large flow path exists for fuel flowing out of the control chamber 18 to the low pressure drain 40 via the flow passage 52, the second axial drilling 44 in the shim plate 16, the cross slot 46 and the shim plate chamber 36. In parallel, fuel also flows out of the control chamber 18 through the first axial drilling 42 in the shim plate 16, the cross slot 46 and the shim plate chamber 36. During this initial stage of lift when Bernoulli forces are present, the rate of damping of movement of the valve needle is relatively low as fuel flow out of the control chamber 18 to the low pressure drain 40 is relatively unrestricted by virtue of the flow passage 52 being fully uncovered.

As the valve needle continues to lift away from the valve needle seat, the step 24 along the length of the needle piston 20 moves past the lower edge of the entry port 52*a* to the flow passage 52 so that the entry port 52*a* becomes partially covered by the needle piston 20. During this middle stage of valve needle movement the flow of fuel out of the control chamber 18 through the flow passage 52 is more restricted, and so the damping of valve needle movement is increased (i.e. movement of the valve needle is more heavily damped during the middle range of movement compared to the initial range of movement). The rate of flow out of the control chamber 18 is restricted still further as the valve needle continues to move through its range of movement and the entry port 52*a* to the flow passage 52 is closed to an increasingly greater extent. Damping of valve needle movement is therefore most significant towards the end of its range of movement.

Towards the very end of its range of travel, as the tip 26 of the needle piston 20 approaches the first axial passage 42, a further throttling effect occurs, localised at the entry port to the first axial passage 42, so that the rate of flow of fuel out of the control chamber 18 is reduced further. Eventually the tip 26 of the needle piston 20 hits the upper lift stop 54 so that the first axial passage 42 is covered completely. The optimum damping profile at the end of lift can be achieved by selecting (i) the relative sizing of the diameter of the tip 26 and the diameter of the remainder of the needle piston 20, (ii) the relative height of the tip 26 and the step 24 and (iii) the shape of the tip 26 (e.g. whether it is tapered or has another profile).

In an alternative embodiment, the first axial passage 42 may be offset from axial alignment with the needle piston 20 so that this localised throttling effect at the very end of full lift is avoided altogether.

At the point at which the entry port 52*a* to the flow passage 52 becomes fully covered by the needle piston 20, the only flow out of the control chamber 18 is through the first axial passage 42 in the shim plate 16 which presents a fixed restriction to fuel. At this point, as the rate of flow of fuel out of the control chamber 18 is reduced (compared to when two flow routes are available), the rate of depressurisation of the control chamber 18 is reduced and, hence, the rate at which the valve needle continues to move towards its fully open position is also reduced. The needle piston 20 therefore approaches its upper lift stop 54 at a reduced velocity compared to the initial opening speed when both flow passages 52, 42 are open.

The point at which the entry port 52*a* to the flow passage 52 becomes fully covered may occur after the valve needle has moved only a short way through its full range of movement or may occur as the needle piston 20 approaches the end of its full range of movement, just prior to hitting the upper lift stop 54. Once the entry port 52*a* to the flow passage 52 is fully covered, the remainder of movement of the valve needle is therefore governed solely by the rate of flow of fuel through the first axial passage 42 in the shim plate 16. To this end, the geometry of the valve needle, and the point at which the entry port 52*a* to the flow passage 52 becomes fully covered, are selected so as to give the desired lift characteristics and to ensure that the velocity at which the needle piston 20 approaches the upper lift stop 54 is reduced compared to its initial speed of movement just after valve needle opening.

In an alternative embodiment, the flow passage 52 in the injector body 12 may remain slightly uncovered even as the needle piston 20 approaches the upper lift stop 54 so that there is a parallel flow through both first and second axial passages 42, 44 through the full range of valve needle movement.

In the simplest form, the tip 26 on the needle piston 20 is of sufficiently narrow a diameter to ensure there is no significant restriction to fuel flow as it flows into the entry port 52*a*. If the step 24 is machined to have a relatively small step back in diameter (i.e. the tip 26 has a relatively large diameter) it would provide the dominant restriction to fuel flow out of the control chamber 18 when the entry port 52*a* is fully open, transitioning to a lesser proportion of the restriction as the entry port 52*a* closes. A parallel-sided tip 26 provides this potential advantage of changing the relationship between port size, valve needle lift and restriction. A taper on the tip 26 would provide further refinement to the damping characteristics of valve needle lift.

During the valve needle closing phase, that is when the NCV 10 is de-actuated, the head portion 32*b* of the valve pin is urged against the first valve seat 48 and the second valve seat 50 is open so that fuel flows from the second supply passage 30, past the second valve seat 50 and into the control chamber 18. Assuming the flow passage 52 is fully covered when the needle piston 20 is against its upper lift stop 54, initially fuel flows into the control chamber 18 only through the first axial passage 42 in the shim plate 16. As the needle piston 20 starts to move away from the upper lift stop 54, the entry port 52*a* to the flow passage 52 starts to open, at which point fuel flows into the control chamber 18 through two routes: a first route through the cross slot 46 and the first axial passage 42 in the shim plate 16 and a second route through the cross slot 46, the second axial passage 44 in the shim plate 16 and the flow passage 52 in the injector body 12. This causes a rapid equalisation of pressure between the control chamber 18 and the nozzle chamber during the closing phase. The needle spring then provides the force to close the valve needle against the valve needle seat with rapid movement and, hence, a rapid termination of fuel injection is achieved.

In a still further embodiment, the first axial passage 42 in the shim plate 16 may be removed altogether so that the flow passage 52 in the injector body 12 is the only flow path for fuel out of the control chamber 18 when the NCV 10 is actuated. In this case the range of valve needle movement and the overlap between the needle piston 20 and the flow passage 52 must be sized to ensure that the flow passage 52 is still open partially at full lift (i.e. the valve needle fully-open position) and is not fully covered. This ensures that the flow passage 52 can still provide a refilling capability for the control chamber 18 at the top of needle lift when it is required to re-pressurise the control chamber 18 to close the valve needle.

In addition to the advantages provided by the invention through the use of a variable area flow passage for fuel flow out of the control chamber 18, the injector provides further advantages by virtue of the shim plate 16 located between the injector body 12, in which the needle piston 20 is guided, and the NCV housing 14, within which the valve pin 32*a*, 32*b* is guided. Firstly, it is beneficial to define the shim plate chamber 36 in a separate part (the shim plate 16), rather than in the NCV housing 14 itself, as the shim plate chamber 36 can be manufactured conveniently by boring or drilling through the shim plate 16 from one side to the other. Secondly, the presence of the shim plate 16 allows the guide bore 34 for the guide portion 32*a* to be located as closely as possible to a grinding spindle support during manufacture: it is considered important for the grinding spindle to approach the guide bore 34 from below (in the orientation shown in FIG. 1) as it is the lower surface of the NCV housing 14 which has to be especially accurately orientated at right angles to the guide bore 34. Thirdly, the presence of the shim plate 16 enables the second valve seat 50 of the NCV 10 to be located on the lower surface of NCV housing 14, enabling a convenient manufacturing processes and ensuring accurate depth to the second valve seat 50. Other advantages include: the lift of the valve pin 32*a*, 32*b* may be set by selecting the appropriate thickness for the shim plate 16; the head portion 32*b* of the valve pin can be kept to a minimum height and the volumes of the shim plate chamber 36 around the head poriton 32*b* (and the other control volumes and passages 46, 42, 44 in the shim plate) can easily be kept relatively small, and the shim plate 16 enables some passages to be fabricated in a manner which might otherwise be difficult to manufacture or create stress raisers.

As a further modification, the second valve seat 50 may be recessed slightly instead of defining a sharp edge (90 degree in cross section), for example the right angled corner may be provided with a chamfer thereby defining a frustoconical surface complementing the frustoconical seating shoulder of the head portion 32*b*. This feature guards against impact damage between the head portion 32*b* and the second valve seat 50.

Although the NCV 10 has been described previously as a three-way valve, the injector can also be configured to operate with a two-way valve. In this case, the NCV has only a single seat between the second supply passage 30 and the shim plate chamber 36 and so an additional flow path into the control chamber 18 is required to allow re-filling of the control chamber 18 when it is required to re-seat the needle piston 20 at the end of injection. Typically, this additional flow path may be provided by a controlled flat at the top of the needle piston 20, a hole through the needle piston 20 or a drilling directly from the supply passage 28 into the control chamber 18.

The present invention may be implemented in a common rail injector, in which a common supply (rail) delivers fuel to at least two injectors of the engine, in an electronic unit injector (EUI) in which each injector of the engine is provided with its own dedicated pump, and hence high pressure fuel supply, within the same unit as the injector, or within an Electronic Unit Pump (EUP) in which each injector of the engine is provided with its own dedicated pump, and hence high pressure fuel supply, but separated from the associated injector via pipework. The invention may also be implemented in a hybrid scheme, having dual common rail/EUI functionality.

The invention claimed is:

1. A fuel injector for use in delivering fuel to an internal combustion engine, the fuel injector comprising:

a nozzle having a valve needle which is moveable with respect to a valve needle seating through a range of movement between a fully-closed position and a fully-open position to control fuel delivery through at least one nozzle outlet, whereby movement of the valve needle is controlled by fuel pressure within a control chamber; and a nozzle control valve for controlling fuel flow into and out of the control chamber to pressurise and depressurise the control chamber, respectively, the fuel injector further comprising a variable flow passage arrangement in communication with the control chamber for varying the rate of flow of fuel out of the control chamber throughout the range of movement of the valve needle such that movement of the valve needle is damped to a greater extent as it approaches the fully-open position compared to initial movement away from the fully-closed position, wherein the injector further comprises an additional flow passage in communication with the control chamber through which fuel flows out of the control chamber;

whereby fuel flows into the control chamber through at least one of the variable flow passage arrangement and the additional flow passage in order to move the valve needle to the fully-closed position.

2. A fuel injector as claimed in claim 1, wherein the additional flow passage presents a fixed restriction to the fuel flow out of the control chamber.

3. A fuel injector as claimed claim 1, wherein the valve needle or a part carried thereby includes a formation at its end remote from the valve needle seating which cooperates with the additional flow passage to provide a further localised damping effect for the valve needle just prior to it reaching its fully-open position.

4. A fuel injector as claimed in claim 1, wherein the variable flow passage arrangement is provided by cooperation between the valve needle or a part carried thereby and a flow passage into the control chamber, whereby the valve needle or the part carried thereby cooperates with the flow passage to a variable degree throughout the range of movement of the valve needle to provide a variable rate of flow of fuel through the variable flow passage arrangement.

5. A fuel injector as claimed in claim 4, wherein an entry port to the flow passage into the control chamber is uncovered by the valve needle or the part carried thereby to a lesser degree when the valve needle is in the fully-open position compared to the extent of uncovering when the valve needle is in the fully-closed position.

6. A fuel injector as claimed in claim 5, wherein the entry port to the flow passage is fully covered by the valve needle or the part carried thereby when the valve needle is in the fully-open position.

7. A fuel injector as claimed in claim 5, wherein the entry port to the flow passage is at least partially uncovered by the valve needle or the part carried thereby when the valve needle is in the fully-closed position.

8. A fuel injector as claimed in claim 7, wherein the entry port to the flow passage is fully uncovered when the valve needle is in the fully-closed position.

9. A fuel injector as claimed in claim 8, wherein the entry port to the flow passage remains fully uncovered for a portion of the range of movement of the valve needle immediately following initial movement away from the fully-closed position.

10. A fuel injector as claimed in claim 1, wherein the nozzle control valve is a three-way control valve.

11. A fuel injector as claimed in claim 1, wherein the control chamber is defined in an upper surface of an injector body within which the valve needle or a part carried thereby is guided and wherein a shim plate closes the open end of the control chamber.

12. A fuel injector as claimed in claim 11, wherein the shim plate is located between the injector body and a control valve housing for the nozzle control valve, the nozzle control valve having first and second valve seats defined by the injector body and the nozzle control valve, respectively.

13. A fuel injector as claimed in claim 12, wherein the shim plate is provided with a shim plate chamber which extends through the shim plate and receives a portion of a valve pin of the control valve.

14. A fuel injector for use in delivering fuel to an internal combustion engine, the fuel injector comprising:

a nozzle having a valve needle which is moveable with respect to a valve needle seating through a range of movement between a fully-closed position and a fully-open position to control fuel delivery through at least one nozzle outlet, whereby movement of the valve needle is controlled by fuel pressure within a control chamber;

a nozzle control valve for controlling fuel flow into and out of the control chamber to pressurise and depressurise the control chamber, respectively;

a variable flow passage arrangement in communication with the control chamber for varying the rate of flow of fuel out of the control chamber throughout the range of movement of the valve needle such that movement of the valve needle is damped to a greater extent as it approaches the fully-open position compared to initial movement away from the fully-closed position; and an additional flow passage in communication with the control chamber through which fuel flows out of the control chamber;

wherein the variable flow passage arrangement is provided by cooperation between the valve needle or a part carried thereby and a flow passage into the control chamber, whereby the valve needle or the part carried thereby cooperates with the flow passage to a variable degree throughout the range of movement of the valve needle to provide a variable rate of flow of fuel through the variable flow passage arrangement;

whereby fuel flows into the control chamber through at least one of the variable flow passage arrangement and the additional flow passage in order to move the valve needle to the fully-closed position.

15. A fuel injector for use in delivering fuel to an internal combustion engine, the fuel injector comprising:

a nozzle having a valve needle which is moveable with respect to a valve needle seating through a range of movement between a fully-closed position and a fully-open position to control fuel delivery through at least one nozzle outlet, whereby movement of the valve needle is controlled by fuel pressure within a control chamber;

a nozzle control valve for controlling fuel flow into and out of the control chamber to pressurise and depressurise the control chamber, respectively, a variable flow passage arrangement in communication with the control chamber for varying the rate of flow of fuel out of the control chamber throughout the range of movement of the valve needle such that movement of the valve needle is damped to a greater extent as it approaches the fully-open position compared to initial movement away from the fully-closed position; and an additional flow passage in communication with the control chamber through which fuel flows out of the control chamber;

wherein the valve needle or a part carried thereby includes a formation at its end remote from the valve needle seating which cooperates with the additional flow passage to provide a further localised damping effect for the valve needle just prior to it reaching its fully-open position;

whereby fuel flows into the control chamber through at least one of the variable flow passage arrangement and the additional flow passage in order to move the valve needle to the fully-closed position.

16. A fuel injector as claimed in claim 1 wherein fuel flows into the control chamber through the variable flow passage arrangement and the additional flow passage in order to move the valve needle to the fully-closed position.

17. A fuel injector as claimed in claim 14 wherein fuel flows into the control chamber through the variable flow passage arrangement and the additional flow passage in order to move the valve needle to the fully-closed position.

18. A fuel injector as claimed in claim 15 wherein fuel flows into the control chamber through the variable flow passage arrangement and the additional flow passage in order to move the valve needle to the fully-closed position.

* * * * *